United States Patent [19]

Catanese et al.

[11] 4,041,342

[45] Aug. 9, 1977

[54] ELECTRON MULTIPLIER WITH BEAM CONFINEMENT STRUCTURE

[75] Inventors: Carmen Anthony Catanese, Rocky Hill; Scott Allen Keneman, Trenton, both of N.J.

[73] Assignee: RCA Corporation, New York, N.Y.

[21] Appl. No.: 714,358

[22] Filed: Aug. 16, 1976

[51] Int. Cl.[2] ..... H01J 43/18; H01J 43/10

[52] U.S. Cl. ..... 313/105 R; 313/400

[58] Field of Search ..... 313/95, 105 R, 400, 313/422, 105 CM, 104, 103 CM, 103 R

[56] References Cited

U.S. PATENT DOCUMENTS

| | | | |
|---|---|---|---|
| 3,668,388 | 6/1972 | Fisher et al. | 313/105 X |
| 3,735,184 | 5/1973 | Maeda | 313/95 X |
| 3,904,923 | 9/1975 | Schwartz | 313/105 X |

*Primary Examiner*—Robert Segal

*Attorney, Agent, or Firm*—Glenn H. Bruestle; George E. Haas

[57] ABSTRACT

An electron multiplier includes a plurality of staggered parallel dynodes. The dynodes include spaced confinement bumps along their lengths with active areas between the bumps. The confinement bumps and active areas therebetween define a plurality of channels which extend from a cathode at one end of the multiplier. Each channel traverses the staggered parallel dynodes and causes an electron beam to pass therethrough without spreading. The multiplier is useful in a display device which includes a plurality of line sources of electrons, e.g., a plurality of cathode stripes.

18 Claims, 15 Drawing Figures

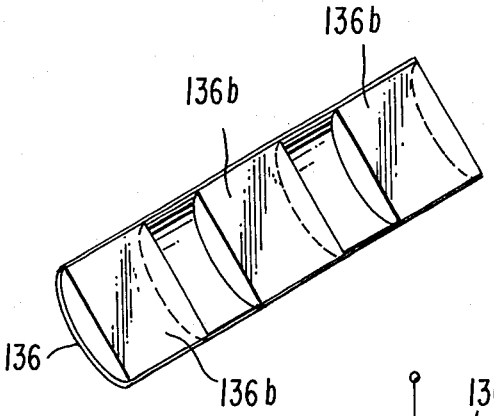
Fig. 12b.
Fig. 12a.
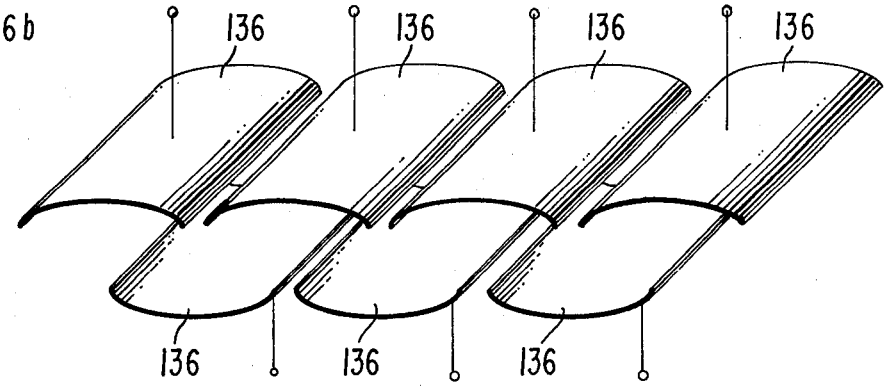
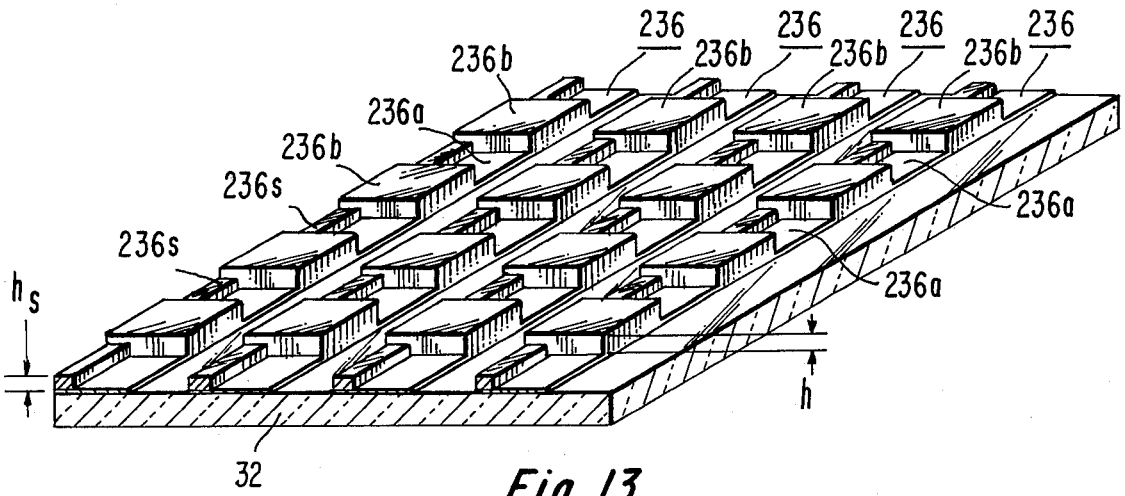
Fig. 13.

ELECTRON MULTIPLIER WITH BEAM CONFINEMENT STRUCTURE

BACKGROUND OF THE INVENTION

This invention relates to electron multipliers, and particularly to a multiplier structure which includes a periodic nonplanar structure for confining the flow of electrons therethrough.

Display devices have been proposed in which electron multipliers operated in a feedback mode are used to provide current to light up a cathodoluminescent screen. For example, see U.S. Pat. No. 3,904,923 entitled "CATHODOLUMINESCENT DISPLAY PANEL." issued Sept. 9, 1975 to J. Schwartz. In one such structure, the electron multiplier includes at least two vanes having a plurality of parallel dynodes disposed in staggered relation thereon with a cathode at one end. This structure is further described in copending application of Ser. No. 672,122, filed Mar. 31, 1976, entitled, "PARALLEL VANE STRUCTURE FOR A FLAT DISPLAY DEVICE." In this structure, electrical potentials of increasing magnitude are provided to the successive multiplying dynodes so as to produce an electron beam at the multiplier output. Generally, the electron multiplier has an open structure to allow feedback of ions which results in sufficiently high loop gain to produce sustained electron emission.

A requirement of such a display is that the electron beam be confined to an area of the screen which is no larger than one picture element. Typically, the largest dimension of such an element is of the order of the width of a single dynode. However, in the previously described electron multipliers, spreading of the electron beam occurs in the direction along the length of the dynodes. This spreading is caused by nonzero secondary electron energies. Typically, this spreading, at normal operating voltages, results in an output beam size which is substantially larger than the dynode width and, hence, undesirable. Thus, it would be desirable to develop a multiplier design in which the electron beam is confined to a narrow length along the length of the dynodes as it traverses the dynodes.

SUMMARY OF THE INVENTION

An electron multiplier includes at least two spaced substrates of electrically insulative material with a cathode at one end of the substrates. A plurality of parallel dynodes are disposed on the surfaces of the substrates which face each other with the dynodes on one of the surfaces being in staggered relation to the dynodes on the other of the surfaces. At least some of the dynodes include a nonplanar structure periodically along the length thereof. The nonplanar structure forms channels extending from the cathode and traversing the parallel dynodes.

BRIEF DESCRIPTION OF THE DRAWINGS

FIGS. 9, 10, 11 and 13 are perspective views showing variations of the multiplier structure of the present invention. FIGS. 12*a* and 12*b* are perspective views showing other multiplier structures with which the electron multiplier of the present invention is compatible.

DETAILED DESCRIPTION OF THE INVENTION

Figure 1:
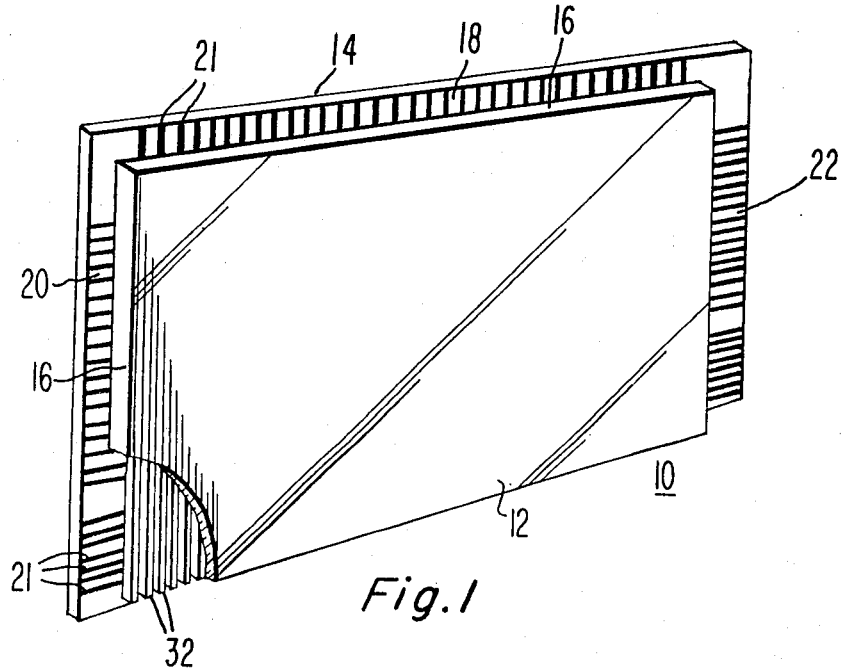
FIG. 1 is a partially cut away perspective view of a flat panel image display device employing the electron multiplier of the present invention.

Referring initially to FIG. 1, one form of a flat image display device 10 of the present invention includes an evacuated glass envelope having a flat transparent viewing front panel 12 and a flat back panel 14. The front and back panels 12 and 14 are parallel and sealed together by peripheral side walls 16. The back panel 14 extends beyond the side walls 16 of the device 10 to form terminal areas 18, 20 and 22. Each of the terminal areas has a plurality of leads 21 which interconnect to internal components for activating and controlling the device. In one embodiment, the overall dimensions of the device 10 may be 84cm high by 112cm wide by 3cm thick with a viewing area of 76cm by 102cm.

Figure 2:
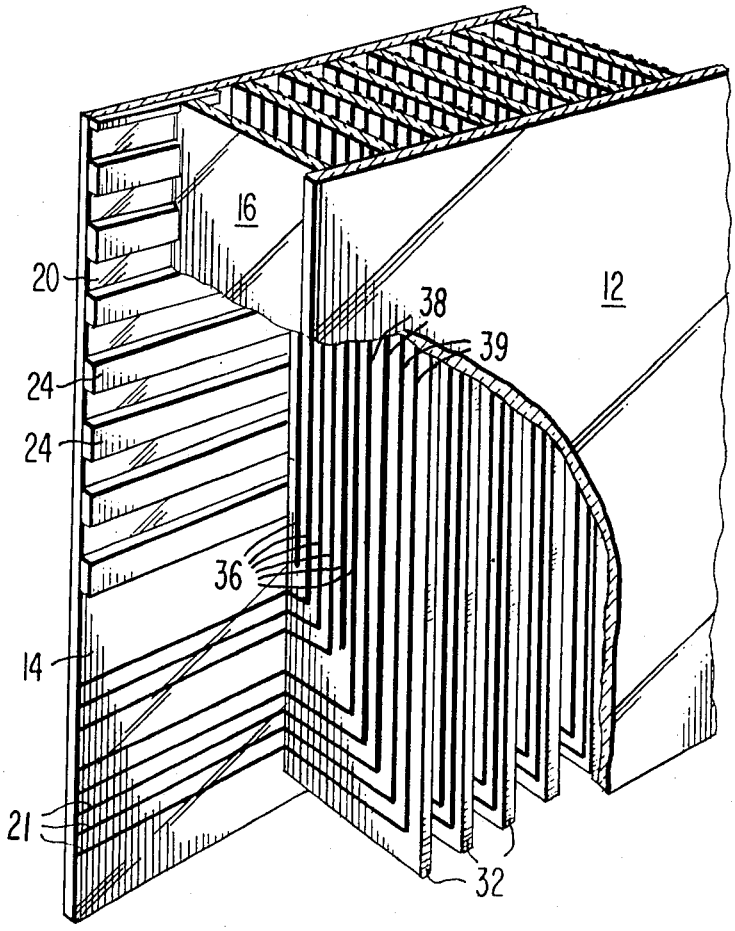
FIG. 2 is an enlargement of the cut-away section of FIG. 1.

The internal structure of the device 10 is shown in the cutaway view of FIG. 2. The back panel 14 has a plurality of cathode stripes 24 on its inside surface. Each stripe 24 is of a conductive material, such as metal, which may be overcoated with a thin layer of a material that provides a high electron emission under bombardment by a feedback species, such as ions or photons. For example, in the case of ion feedback, the emissive material may be MgO or BeO. The cathode stripes 24 can be coated onto the back panel in the desired pattern by a variety of techniques, e.g., sputtering or evaporation of the component metal followed by photo-etching and oxidation.

A plurality of spaced parallel vanes 32 extend between and are in perpendicular contact with the front and back panels 12 and 14. The vanes 32 are arranged orthogonal to the cathode stripes 24. Intrasupport of the front and back panels 12 and 14 is provided by the vanes 32. Each of the vanes 32 is formed from flat insulating material, such as glass or ceramic. Each vane 32 includes on each of its major surfaces a plurality of spaced electron multiplier dynodes 36 and a plurality of spaced electrodes 38 and 39 for accelerating, modulating, and focusing electron beams. Both the dynodes 36 and the electrodes 38 and 39 may be formed as stripes running orthogonally with respect to the cathode stripes 24.

The front panel 12 is preferably of glass and serves as the viewing faceplate of the device 10. The internal surface of the front panel 12 is covered with a plurality of phosphor stripes (not shown) which are capable of emitting light upon electron bombardment. The phosphor strips are orthogonal to the cathode stripes 24 on the back panel 14. Each phosphor stripe extends parallel to and is disposed between each set of adjacent vanes 32. If the device 10 is intended to display a color image, the internal surface of the faceplate 12 may be covered with alternating red, green, and blue light emitting phosphor stripes.

Figure 3:
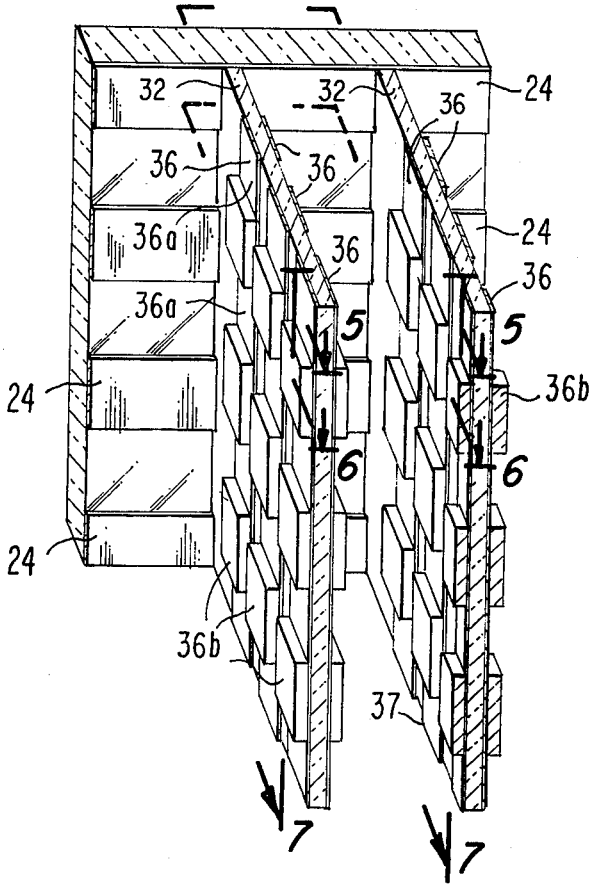
FIG. 3 is an enlarged view of a portion of the section shown in FIG. 2.
Figure 4:
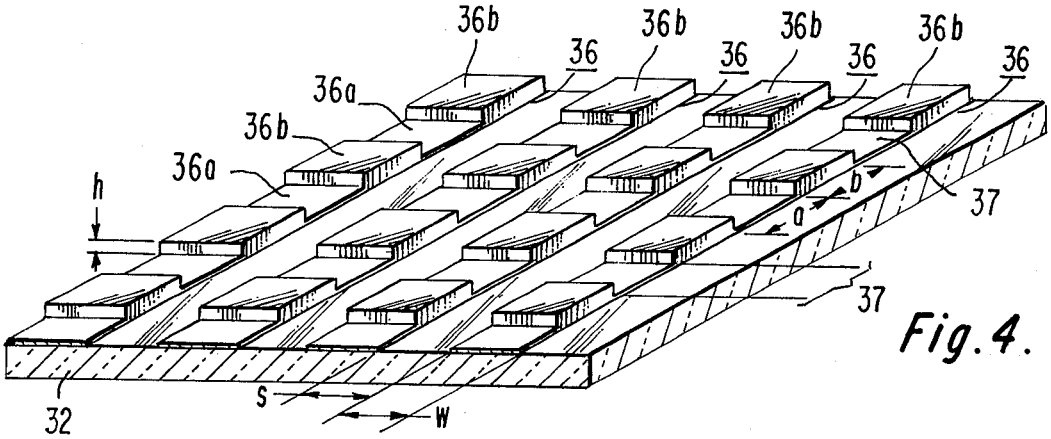
FIG. 4 is a perspective view of a vane having multiplier structure thereon.

Referring now to FIGS. 2 and 3, the dynodes 36 on the surfaces of the vanes 32 which face each other are disposed in staggered relation with the dynodes 36 being in parallel relation lengthwise. The dynodes 36 include a nonplanar structure, e.g., confinement bumps 36*b,* as shown in FIGS. 3 and 4. The confinement bumps 36*b* are rectangularly shaped and are arranged periodically along the length of the dynodes 36. That is, each adjacent pair of confinement bumps 36*b* along the length of a dynode 36 includes an active dynode area 36*a* therebetween, as shown in FIG. 4. The confinement bumps 36*b* form channels 37 from the cathode stripes 24 in directions orthogonal to the parallel dynodes. The nonplanar dynode structure shown in FIG. 4 can be conveniently constructed by bonding a foil to a substrate through the application of heat and pressure. The foil should be of a material which can be activated to have a high secondary electron emission coefficient ($\delta$), such as magnesium-aluminum alloy. The desired dynode pattern can then be embossed and defined in the foil. It should be noted that the embossing of the foil can be performed either before or after bonding the foil to the substrate. Particularly preferable for bonding the foil to the substrate is a bonding process known as anodic bonding, e.g., see U.S. Pat. No. 3,397,278, entitled "ANODIC BONDING," issued Aug. 13, 1968 to D. I. Pomerantz.

For ease of description, in FIG. 4, each dynode 36 is further considered to include an active area 36*a* of length *a,* and a confinement bump 36*b* of length *b.* The width of the dynode is *w* and the separation between adjacent dynodes is *s.* The center-to-center separation $(a + b)$ is designed to equal the desired resolution width of the display in a direction parallel to the length of the dynodes. Typically, the height *h* of the confinement bump 36*b* is approximately one fourth to one third of the dynode width *w* and the spearation *s* between the dynodes is 0.4w.

Figure 5:
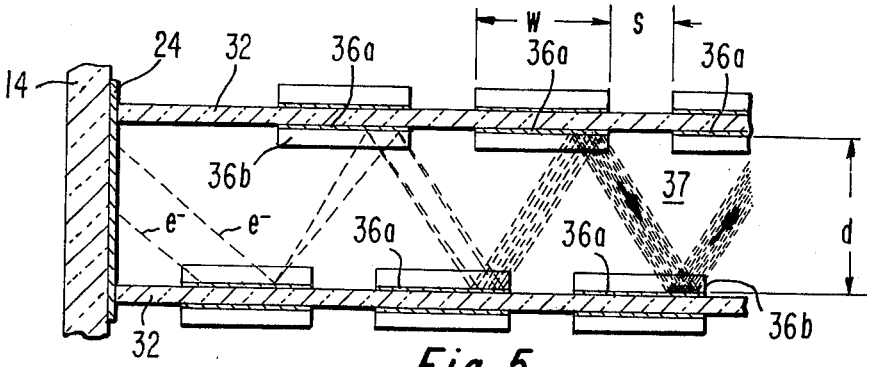
FIG. 5 is a sectional view taken along line 5—5 of FIG. 3 showing electron multiplication which occurs within one channel in the multiplier of the display device of FIG. 1.

Generally, in the operation of the display device 10, the cathode stripes 24 provide input electrons for the dynodes 36 as shown in the structure of FIGS. 2 and 3 and in the schematic of FIG. 5. Each of the cathode stripes 24 can be considered a line source of electrons. If the cathode stripe 24 is electrically more negative than the first dynode 36, electrons emitted by the stripe 24 will be attracted to the first dynode, as shown schematically in FIG. 5. However, if the cathode stripe is more positive than the first dynode, the emitted electrons will not reach the first dynode. Thus, the electron flow may be turned on and off in various regions of the multiplier by biasing various cathode stripes 24. Increasing voltages are applied to the multiplier dynodes 36 from the dynode closest to the cathode stripes 24 to the dynode closest to the front panel 12. For example, in the embodiment described herein, a dynode to dynode voltage increase of 200 volts permits acceptable multiplier operation. The multiplier is initially fired or started by primary electrons emitted from the cathode which may be caused by cosmic or other external radiation impinging thereon or by other causes. The electron current emitted from a negatively biased cathode stripe 24 is amplified through the very large gain of the dynodes 36.

The description will now continue with a discussion of how the nonplanar structure of the present invention substantially minimizes the spreading of the electron beam from the cathode stripes 24.

Specifically, within each one of the channels 37 defined by the confinement bumps 36*b,* electrons ($e^-$) from the cathode stripes 24 are multiplied as they traverse the active area 36*a* of each of the staggered dynodes 36, as shown in FIG. 5. The spacing *d* between the active areas 36*a* of opposing dynodes is of a dimension so as to provide for good steering of electrons from the emitting area of one dynode to the emitting area of the next dynode. Typically, the separation *d* is of the order of 0.95*w,* where *w* is the dynode width. At this point, it should be noted that, in a symmetrical dynode structure, as here, one half of a dynode is an emitting area and the other half is not. By this it is meant that the half of each dynode 36 furthest from the cathode stripes 24 emits secondary electrons while the half closest to the cathode stripes 24 does not, as shown in FIG. 5. This is due to the fact that the electrical fields at the dynode half closest to the cathode stripes 24 are such that electrons emitted therefrom are attracted back to the dynode while the electrical fields at the dynode half furthest from the cathode stripes 24 are such that electrons emitted therefrom are attracted to the next multiplying dynode.

Figure 6:
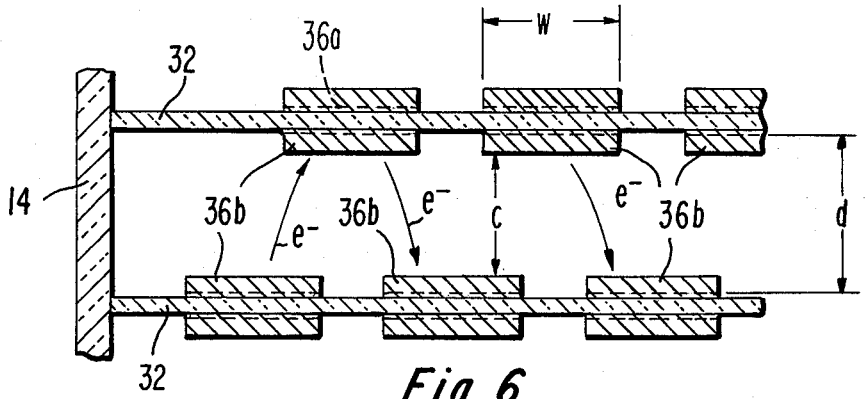
FIG. 6 is a sectional view taken along line 6—6 of FIG. 3 showing the lack of electron multiplication which occurs outside of a channel in the multiplier of the display device of FIG. 1.
Figure 7:
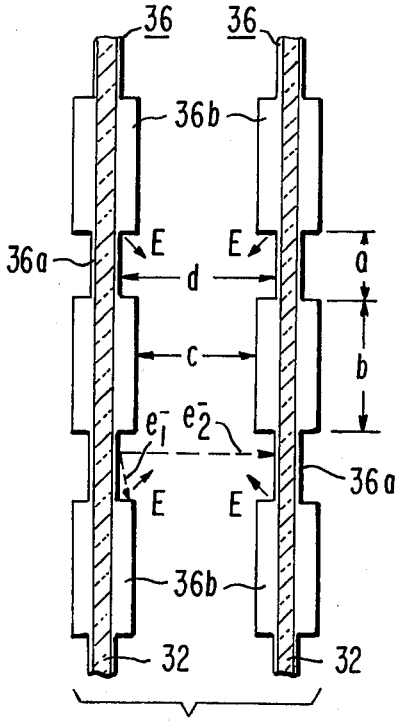
FIG. 7 is a sectional view taken along line 7—7 of FIG. 3 which shows the electrical field seen by the electrons as they travel from dynode to dynode to the cathodoluminescent screen.

The nonplanar dynode structure of the present invention substantially confines the electron beam within the channel 37. This confinement takes place in a direction orthogonal to the major dimension of the cathode stripe 24 and parallel to the back panel 14. The electron beam confinement which occurs within the channels 37 is due to three factors which are schematically shown in FIGS. 6 and 7. One such factor is that the nonplanar structure provided by the confinement bumps 36*b* presents a physical barrier to at least some of the electrons which would otherwise cause the beam to spread out of the channel 37, i.e., the confinement bumps 36*b* actually block many of the high angle electrons (spreading electrons) by acting as a target which merely collects electrons which would otherwise cause beam spreading. This can be seen by comparing the trajectories of two different electrons ($e^-$), as shown in FIG. 7. The high angle electron ($e_1^-$) strikes the confinement bump 36*b* and is blocked while the nonspreading electron ($e_2^-$) within the channel 37 is steered to the active area 36*a* of the next dynode 36.

Referring now to FIG. 6, a second factor which is responsible for the electron beam confinement provided by the nonplanar dynode structure of the present invention can be more fully appreciated. In FIG. 6, the flow of electrons outside of the channel 37 is shown. The electrons shown in FIG. 6 are considered spill-over electrons as they have managed to spill over and out of the channel 37. By comparing FIG. 5 (electron multiplication inside the channel 37) to FIG. 6 (electron multiplication outside the channel 37), it can be seen that the presence of the confinement bumps 36*b* substantially prevents any multiplication of these spill-over electrons from occurring. By preventing multiplication of spill-over electrons, beam spreading is reduced. It can be seen in FIGS. 5 and 6 that spill-over electrons are not multiplied due to the fact that the spacing *c* between the confinement bumps 36*b* is sufficiently smaller than the spacing *d* between the active dynode areas 36*a* whereby the spill-over electrons outside the channel 37 are steered to the non-emitting half of the subsequent dynode. Typically, the spacing *c* between the opposing confinement bumps 36*b* is about ½ the spacing *d* between the active areas 36*a* of opposing dynodes.

The third factor responsible for the electron beam confinement is that the confinement bumps 36*b* provide electrostatic focusing for the electron flow therethrough. This can be seen in FIG. 7 where the electrical field provided by the nonplanar dynode structure is indicated by the symbol $\vec{E}$. This electrical field functions to converge the electron flow passing therethrough. Thus, not only are spreading electrons prevented from reaching the adjacent channel due to the physical barrier provided by the confinement bumps, but, spreading of the electrons is decreased due to the electrostatic focusing effect provided by the confinement bumps. This is a significant result as it means that confinement is achieved without throwing away that portion of the beam which would have spilled over.

Thus, the nonplanar dynode structure of the present invention performs two important functions; electron beam multiplication and electron beam confinement.

Figure 8A:
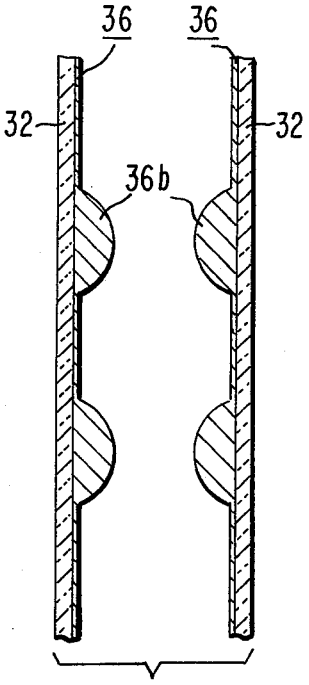
FIGS. 8*a* and 8*b* are sectional views, taken as in FIG. 7 showing multiplier structures which can be simply constructed.
Figure 8B:
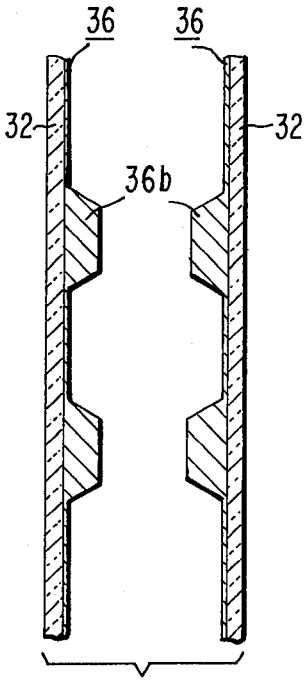

The shape of the previously described confinement bumps can be varied so as to be compatible with simple fabrication techniques. For example, confinement bumps 36*b* having smooth curved edges, as shown in FIG. 8*a*, are more compatible with metal embossing techniques than confinement bumps 36*b* having straight edges, as shown previously in FIGS. 3–7. Another convenient construction includes a confinement bump 36*b* having straight tapered edges, as shown in FIG. 8*b*.

Figure 9:
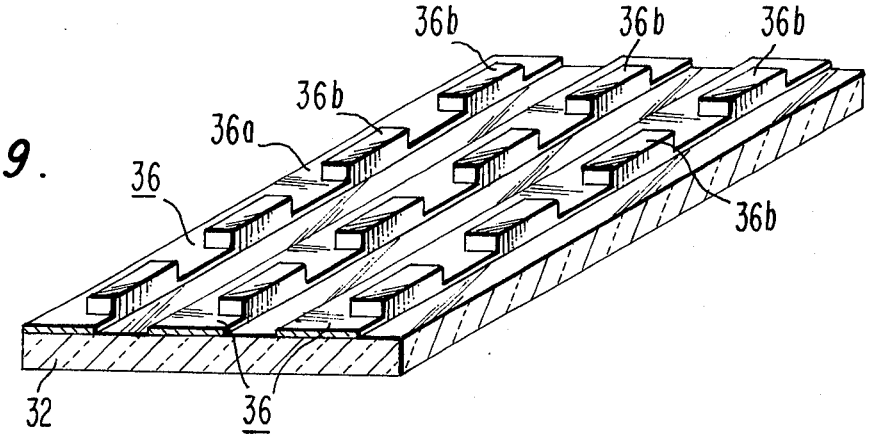
Figure 10:
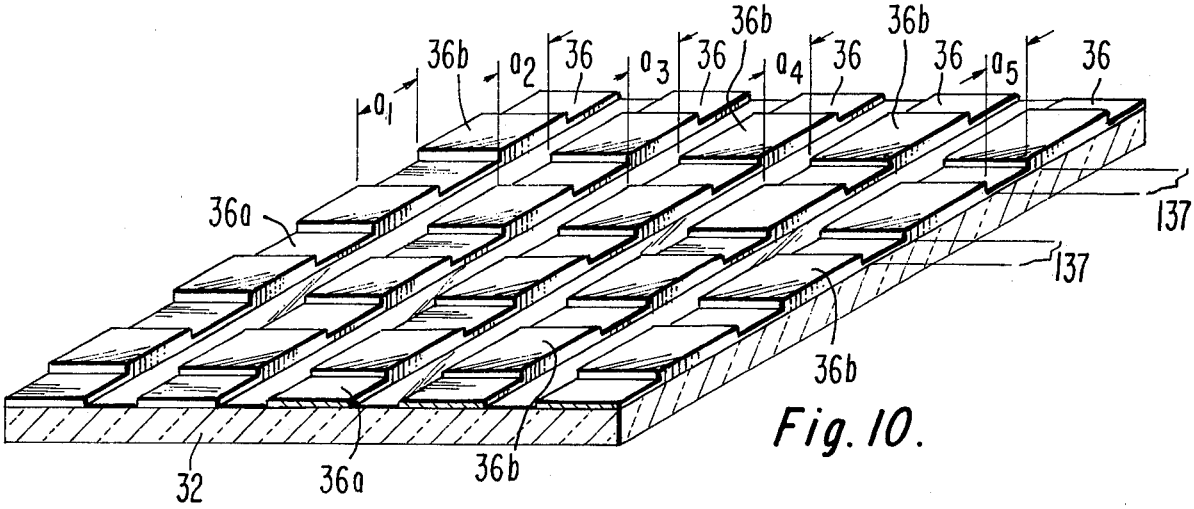

It should also be noted that the confinement bumps 36*b* need not extend over the entire width of the dynode 36, as shown in FIG. 9. The structure shown in FIG. 9 may be desirable in some cases because full width confinement bumps on all the dynodes 36 may degrade the beam confinement by interfering with the highly sensitive electron optics necessary for good electron multiplication. Further, under certain conditions it may be desirable to provide a nonplanar dynode structure in which confinement bumps define a tapered channel for an electron beam. The tapered channel 137, such as the one shown in FIG. 10, provides additional confinement of the electron beam as it traverses the dynodes 36. Although the tapered channel 137 is shown with active areas 36*a* having decreasing lengths $a_1 \ldots a_5$, with $a_1 > a_5$, variations are possible in which the length *a* may increase and/or decrease along the channel 137 (not shown).

Although the dynode structure of the present invention has been described with each dynode being a continuous body and including therein a nonplanar structure, variations are possible. For example, a plurality of confinement bumps can be affixed to a planar dynode.

Figure 11:
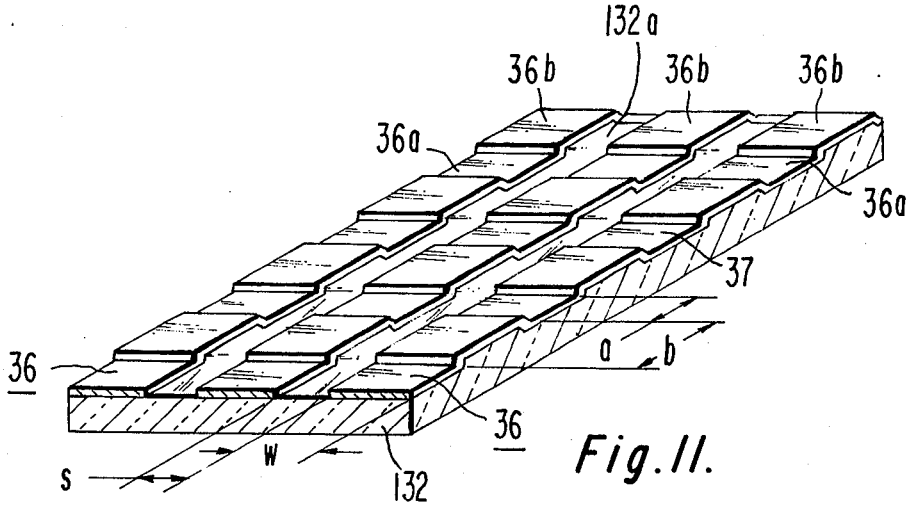

It should be noted that the vanes 32 upon which the nonplanar dynode structure of the present invention is disposed need not be flat. Instead, if desired, the nonplanar dynode structure can be itself disposed upon a substrate which is not flat. For example, a vane 132 having a nonplanar surface 132*a* can be coated with stripes 36 of suitable dynode material, as shown in FIG. 11. In such a case, the stripes 36 conform to the nonplanar surface 132*a*. An advantage of the structure shown in FIG. 11 is that the presence of the nonplanar glass structure provides a physical barrier which enhances beam confinement. In such a case, the stripes 36 conform to the nonplanar surface 132*a*. Also, the vanes upon which the nonplanar structure of the present invention are disposed need not be parallel. For example, the vanes can be wedge shaped, if desired (not shown). However, for ease of construction, it is preferable that the nonplanar structure be disposed on vanes which are parallel.

Although the nonplanar structure, i.e., confinement bumps, have previously been described in connection with a flat multiplier structure, the nonplanar structure is also useful in a conventional curved multiplier, such as the one partially shown in FIG. 12*a*. One dynode 136 of the curved multiplier, modified in accordance with the present invention to include confinement bumps 136*b*, is shown in FIG. 12*b*. The confinement bumps 136*b* are disposed periodically along the length of the dynode 136 with the bumps 136*b* filling the curved surface of the dynode 136.

In addition, if desired, other structure can be included on each of the parallel dynodes. For example, it has recently been proposed that ion shields be included on some of the dynodes in a feedback multiplier. The ion shields function to prevent feedback ions from striking some of the dynodes. One such structure in which the dynode 236 includes confinement bumps 236*b* and ion shields 236*s* is shown in FIG. 13. It should be noted that the height $h_s$ of the ion shields 236*s* is smaller than the height *h* of the confinement bumps 236*b*.

Although the electron multiplier of the present invention has been described in use in a flat image display device which includes a plurality of cathode line stripes, many variations are possible. The electron multiplier of the present invention is useful with other types of line sources of electrons. For example, the cathode line stripes can be replaced with filament type line cathodes, directly or indirectly heated. Thus, there is provided by the present invention, an electron multiplier suitable for use in a cathodoluminescent flat image display device which includes a plurality of line sources of electrons.

We claim:

1. An electron multiplier, comprising:

at least two spaced substrates of electrically insulative material;

a cathode at one end of said substrates; and a plurality of parallel dynodes on the surfaces of said substrates which face each other, said dynodes on one of said surfaces being in staggered relation to said dynodes on the other of said surfaces with at least some of said dynodes including a nonplanar structure periodically along the length thereof, said nonplanar structure forming channels extending from said cathode and traversing said parallel dynodes and comprising confinement bumps which are adjacent to active dynode areas.

2. An electron multiplier in accordance with claim 1 in which said channels are orthogonal to said dynodes.

3. An electron multiplier in accordance with claim 1 in which said substrates are substantially parallel.

4. An electron multiplier in accordance with claim 1 in which said surfaces of said substrates are substantially flat.

5. An electron multiplier in accordance with claim 1 which includes an enclosure housing said multiplier.

6. An electron multiplier in accordance with claim 5, in which said confinement bumps are shaped so as to both confine and electrostatically focus an electron flow from said cathode.

7. An electron multiplier in accordance with claim 5 in which said channels defined by said bumps are tapered.

8. An electron multiplier in accordance with claim 5 in which said confinement bumps are rectangularly shaped and occupy substantially the entire width of said dynodes.

9. An electron multiplier in accordance with claim 5 in which said confinement bumps occupy only a portion of the entire width of said dynodes.

10. An electron multiplier in accordance with claim 1 which is open to feedback of sufficiently high gain to produce sustained electron emission.

11. An image display device, comprising:

an evacuated envelope including a transparent front panel and a back panel spaced from said front panel, said front panel having a cathodoluminescent screen thereon;

means for generating a plurality of substantially parallel line beams of electrons;

a plurality of spaced substantially parallel vanes between said front and back panels, said vanes being substantially orthogonal to said line beams; and a plurality of parallel dynodes disposed on opposing surfaces of said vanes with said dynodes which face each other being in staggered relation, at least some of said dynodes including a nonplanar structure periodically along the length thereof, said nonplanar structure forming channels for confining said line beams of electrons in a direction orthogonal thereto and comprising confinement bumps which are adjacent to active dynode areas.

12. A display device in accordance with claim 11 in which said channels confine said line beams in directions orthogonal to the major dimensions thereof.

13. A display device in accordance with claim 11 in which said confinement bumps are shaped so as to both confine and electrostatically focus an electron flow from said cathode.

14. A display device in accordance with claim 11 in which said channels defined by said bumps are tapered.

15. A display device in accordance with claim 11 in which said confinement bumps are rectangularly shaped and occupy substantially the entire width of said dynodes.

16. A display device in accordance with claim 11 in which said confinement bumps occupy only a portion of the entire width of said dynodes.

17. A display device in accordance with claim 11 in which said means for generating said line beams comprises a plurality of substantially parallel cathode stripes disposed on said back panel.

18. A display device in accordance with claim 12 in which said cathode and said dynode structure are open to feedback of sufficiently high gain to produce sustained electron emission.

* * * * *